United States Patent [19]

Parsonage

[11] 3,970,457

[45] July 20, 1976

[54] AUTOMATIC REPLENISHMENT METHOD AND APPARATUS FOR PHOTOGRAPHIC PROCESSES

[75] Inventor: Harry N. Parsonage, Dayton, Ohio

[73] Assignee: The Mead Corporation, Dayton, Ohio

[22] Filed: Apr. 22, 1974

[21] Appl. No.: 462,663

[52] U.S. Cl. ..... 96/50 R; 96/50 A; 96/60 R; 96/63; 96/66 R; 96/61 R; 96/62

[51] Int. Cl.[2] ..... G03C 5/26; G03C 5/24; G03C 5/38

[58] Field of Search ..... 354/297, 324; 96/48 R, 96/60, 50 R, 61, 63, 66

[56] References Cited

UNITED STATES PATENTS

| | | | |
|---|---|---|---|
| 3,334,566 | 8/1967 | Friedel | 354/297 |
| 3,492,932 | 2/1970 | Van Baerle | 96/48 R |
| 3,529,529 | 9/1970 | Schumacher | 354/297 |
| 3,647,462 | 3/1972 | Surash et al. | 96/66 R |
| 3,770,608 | 11/1973 | Kelch et al. | 204/195 |

OTHER PUBLICATIONS

Mason, Photo. Proc. Chemistry, 1966, pp. 266–267.

*Primary Examiner*—Mary F. Kelley
*Attorney, Agent, or Firm*—Biebel, French & Nauman

[57] ABSTRACT

Disclosed is a method and apparatus for automatically replenishing the chemical solutions consumed in a film developing process, which results in a lessening of the chemical activity of the solutions, and where the consumption of some of the chemicals in some of the solutions are dependent on the amount of imagery processed and the rest of the solutions are dependent on the amount of bulk or non-imagery processed. The process generally involves extracting samples of one of the image dependent and one of the bulk dependent solutions, analyzing the samples to determine the chemical activity therein, and replenishing all of the image dependent solutions in relation to the chemical activity in the image dependent sample and all of the bulk dependent solutions in relation to the chemical activity in the bulk dependent sample. Provisions may be made to recycle or regenerate some of the solutions.

7 Claims, 7 Drawing Figures

AUTOMATIC REPLENISHMENT METHOD AND APPARATUS FOR PHOTOGRAPHIC PROCESSES

BACKGROUND OF THE INVENTION

This invention concerns the automatic replenishment of chemical compositions consumed during photographic processes in which the compositions are used to develop photographic film.

In a photographic process, the latent image in exposed photosensitive emulsions is developed. In the course of the process, the compositions which chemically convert the latent image into a developed picture are consumed, and must be replaced. In black-and-white photography, the developer is consumed in reducing silver halide to metallic silver to create the image.

In color photography, the developer, such as CD-2 (a p-phenylenediamine derivative developer sold by Kodak), hydroquinone and the like, reduces the silver halide on the film to metallic silver, causing the color couplers to react to produce the colored dyes. Additionally, a bleach solution, such as sodium ferricyanide or the like, is used in oxidizing the metallic silver image to silver halide for subsequent solubilization in a fix solution, such as sodium or ammonium thiosulfate (Hypo) or the like, is used to dissolve the silver halide from the film. Other chemical solutions are also used in color photography processes, including stop (or short stop) baths, which are generally acidic solutions (typically acetic acid and the like, of a pH of 5.5 or less), are used instead of a rinse after development, and have the purpose of abruptly stopping development, hardner solutions (e.g. alkaline formalin), conditioner solutions, and the like.

If the photographic developing process is to proceed without interruption, it is necessary to make continuous measurements of the concentrations of the chemicals in the solutions and replenish the solutions with the depleted chemical in response thereto. Prior art photographic processing systems, however, have generally been constrained to replenish on a batch basis, or if continuous replenishment was performed it was done by making continuous measurements of the concentration of each chemical being consumed and replenishing the depleted chemicals on the basis of the measurements associated therewith. One such continuously operating system is disclosed in Schumacher U.S. Pat. No. 3,529,529 wherein the replenishment apparatus draws a sample of developer solution, performs a potentiometric titration to determine the concentration of halogen therein, and adjusts the flow rate of the developer replenisher in response thereto. This method is somewhat awkward and complicated in that titration solution must be stored and transferred, and the titration itself must be performed.

Other prior art systems as shown for instance in Hixon et al. U.S. Pat. No. 3,472,143 have replenished photographic chemicals in response to infrared sensing signals proportional to the area of film being processed. Still other systems as shown in Street et al. U.S. Pat. No. 3,554,109 have measured image density variations to control simultaneous replenishment of developer and fixer solutions. Other examples of prior art photographic replenishment systems are shown in U.S. Pat. Nos. 3,334,566 and 3,680,463.

All of these prior art systems, however, are considered to be awkward, inefficient, or impractical for commercial use in typical contemporary photographic processing laboratories. Further, most of the prior art systems applied to replenishment of single solutions used predominately in black and white film processing. Virtually no such work has been performed for color processing. Accordingly there has existed a need for an improved, simple, economical automatic process for replenishing the chemical compositions consumed during photographic processes.

Further, most processing laboratories are of a relatively small magnitude, and cannot afford to place a process controller on every process solution in the plant. A further need therefore exists for a method and means for controlling replenishment of the developing process chemicals without requiring individual process controllers of each solution.

SUMMARY OF THE INVENTION

The invention is generally directed to an improved method of and apparatus for replenishing the chemical compositions consumed in a photographic process, and specifically to an apparatus and method of replenishing all of the solutions in the process by a simple analytical process involving only a few of the compositions to be replenished.

The process of the invention is an improvement over the prior art processes because it is a simple, relatively uncomplicated, and accurate measuring process, and it eliminates the need for and expense of individual process controllers for each composition used in the process. Thus, plural solutions can be replenished on the basis of a sample taken from only one of the solutions.

The improved replenishing apparatus and process will be discussed in the context of, but is not limited to, a five step process which uses the following solutions: color developer solution, stop bath solution, hardener solution, rehalogenating bleach solution, and fix solution. Alternatively, the improved replenishing process could be used in conjunction with a three step photographic process, such as a process using only a developer, bleach-fix, and stabilizer, wherein only the developer is monitored. It is also applicable to any other photographic process, as long as the replenishment is done in accordance with the principles of the invention expressed herein.

The process of the invention has evolved in part because of the discovery that the amount of imagery processed in the exemplified film developing process is related to the halogen activity, i.e., the bromide level in the bleach solution, when the bleach is a rehalogenating bleach. It was also discovered that the amount of bulk processed in the film developing process is related to the silver activity, i.e., the silver level, in the fix solution. Further, it was discovered that the replenishment requirement of all of the image dependent solutions could be related to the bromide level in the bleach solution, while the replenishment requirement of all of the bulk dependent solutions could be related to the silver level in the fix solution. In the exemplary photographic developing process, the developer and the bleach solutions are the image dependent solutions, while the stop bath, hardner and fix solutions are the bulk dependent solutions.

For the purpose of the disclosure herein, the terms image dependent, imagery dependent and image related are intended to mean that the chemicals are consumed, in the processing of the film, on the basis of the amount of image or imagery present on the undeveloped film. Bulk dependent, bulk related, and non-image or non-imagery dependent means that the chemicals are consumed, in the processing of the film, on the basis of how much film is being transported through the solution tanks over a given period of time.

The term chemical activity is intended to mean the presence or absence of active chemicals, including ions, in the classical physical chemistry definition, in the solutions. For example, the bleach solution converts the silver image in the film to silver halide; usually silver bromide. As the film is processed, the bromide in the solution is consumed to form silver bromide, with a consequential reduction in the level or concentration of the bromide, while the bleach is reduced in oxidizing the free silver to silver ion in situ. Thus, there are several active chemicals in the bleach solution. By monitoring the bromide, for example, the chemical activity of the solution may be determined. But, the chemical activity of the solution might also have been analyzed on the basis of the other bleach chemicals.

By the process of the invention samples of the bleach and fix solutions are extracted and electro-chemically analyzed to determine the chemical activity therein, which are related to the amount of imagery and bulk being processed. But other solutions could be monitored. For example, the developer could be monitored to determine replenishment for the bleach as well as the developer. The rates of replenishment of all of the compositions are then adjusted based on these values. Thus, by only replenishing the image dependent solutions on the basis of imagery, a savings is realized over mere bulk replenishment which results in new chemicals being added whether needed or not. A further savings is realized because of the elimination of the need for process controllers for every solution and/or for every solution ingredient, since the replenishment of all of the solutions can be done with a minimum of controllers. In the exemplary process, only two process controllers are needed.

Also, provisions may be made for the regeneration of the bleach solution and the recycling of the fix solution, as additional measures resulting in further economic gain. The performance of these steps can be economically controlled and monitored in a manner similar to the replenishment process of the invention.

It is therefore an object of the invention to provide an improved method of replenishing the chemical compositions consumed in a photographic process by a simple analytical process on only some of all the compositions to be replenished.

Other objects and advantages of the invention will be apparent from the following description, the accompanying drawings, and the appended claims.

DESCRIPTION OF THE PREFERRED EMBODIMENT

Figure 1:
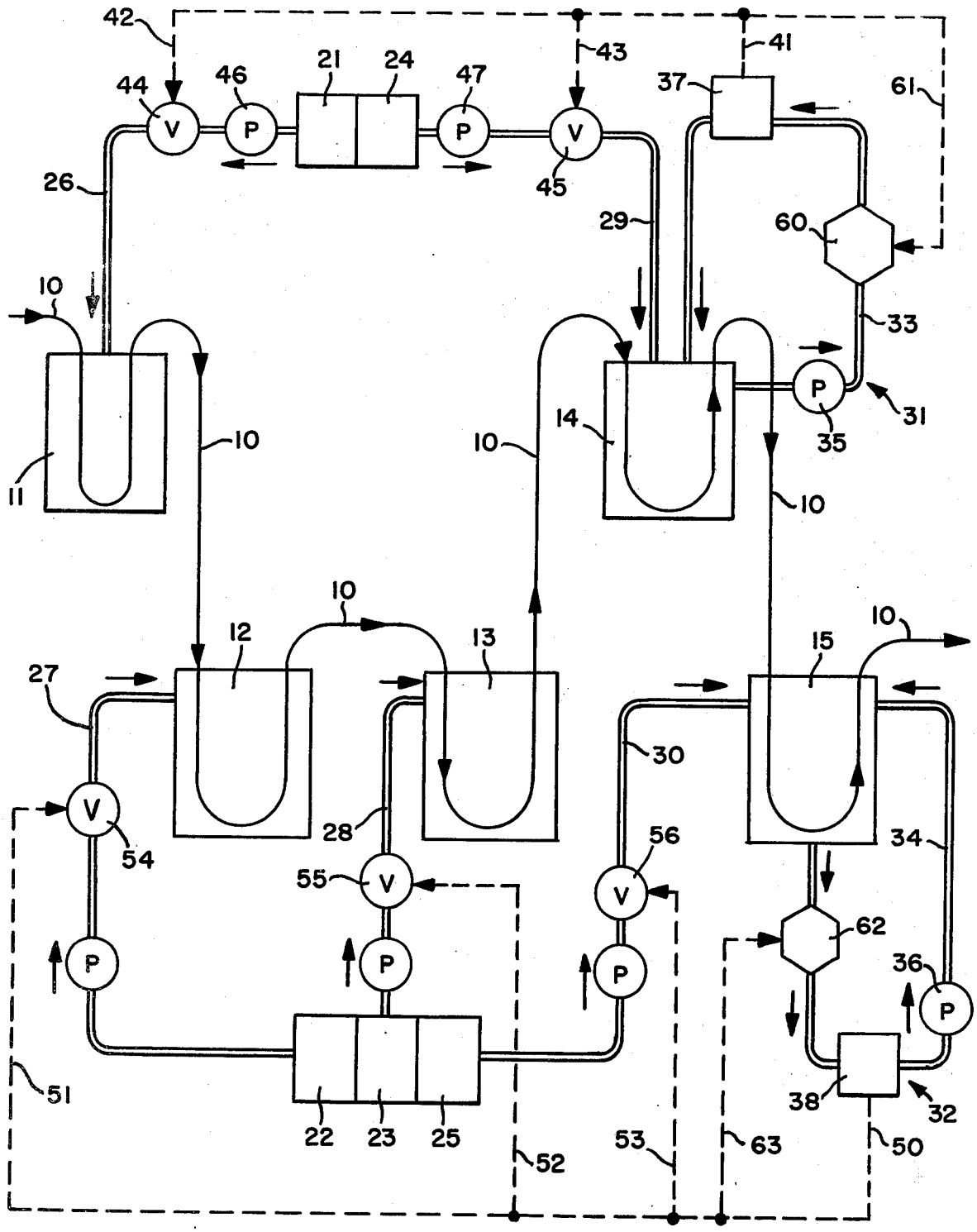
FIG. 1 shows, diagrammatically, a schematic illustration of a typical film developing process, including the measuring of certain compositions used in the process to determine if the process compositions should be replenished and/or treated in any other manner, in accordance with the teachings of the invention.
Figure 2A:
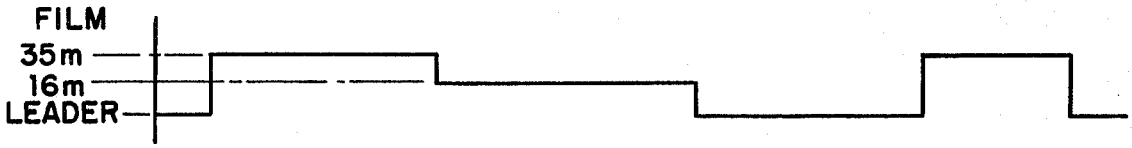
FIGS. 2*a–f* are charts showing the variations in the concentration of, and additions to, the process solution over a common period of time, and depending upon whether film or leader material is being processed.
Figure 2B:
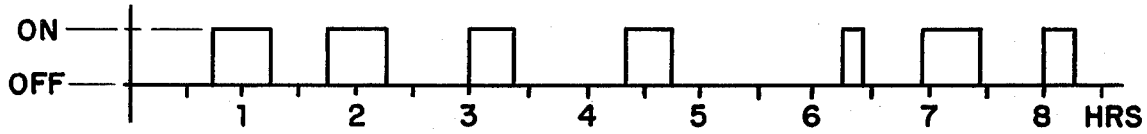
Figure 2C:
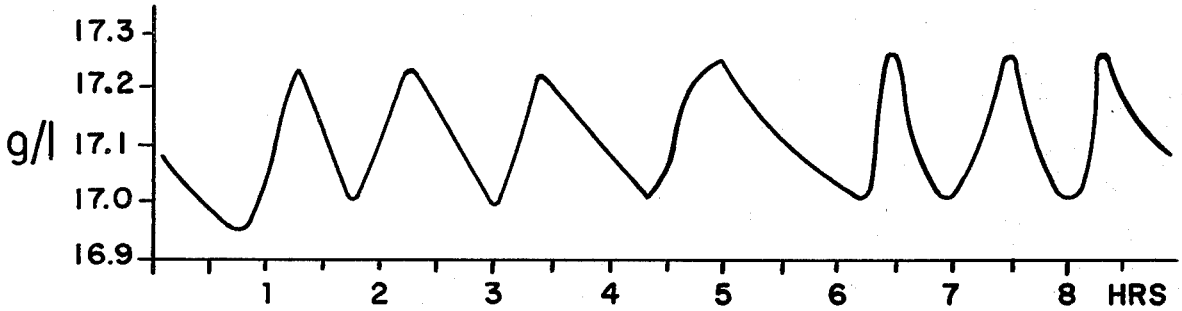
Figure 2D:
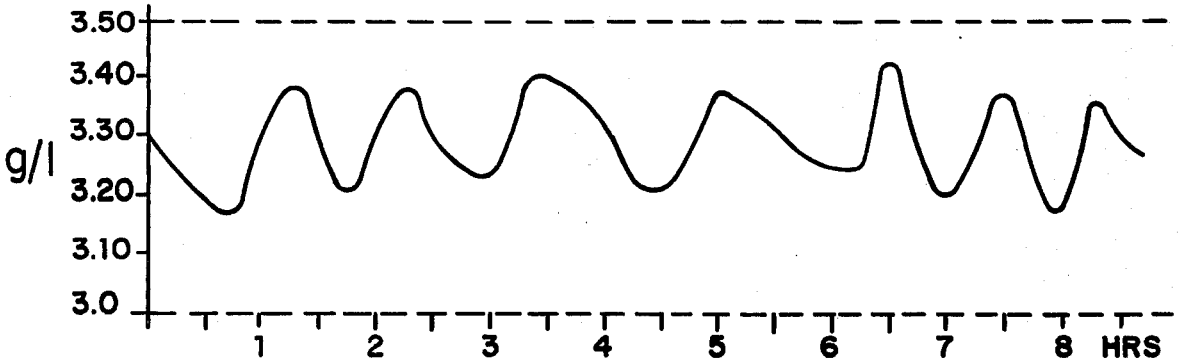
Figure 2E:
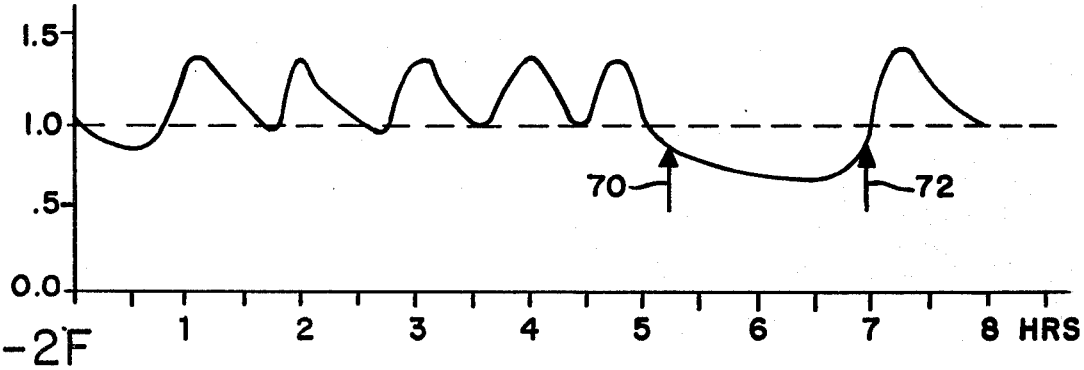
Figure 2F:
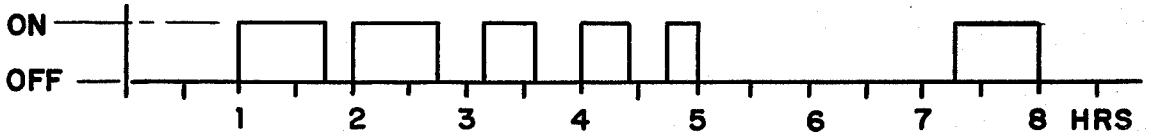

FIG. 1 generally illustrates a color film developing process employing an automatic chemical replenishment system in accordance with the invention. In the developing process, film 10 is passed through tanks containing the developing chemicals, which results in developing of the latent image in the exposed film, including a developer tank 11, a stop bath 12, a hardner solution tank 13, a bleach solution tank 14, and a fix solution tank 15.

As film 10 continuously passes through tanks 11–15 and is developed, the chemical solutions in the tanks are consumed and must be replenished. Replenishment tanks 21–25, and appropriate pipes, 26–30, are provided for the purpose of replenishing the chemicals consumed in the developer, stop bath, hardner, bleach, and fix solutions, respectively.

It is the control of the feeding of the replenishing solutions to the processing tanks 11–15 that is the subject matter of this invention. In the past, the valves which controlled the flow of the replenishing chemicals were either individually hand-set or individually controlled by an individual process controller monitoring each respective solution. The process of the invention is based, in part, upon the discovery that the need for replenishment of all the solutions (in the exemplary photographic process) can be sensed and controlled by monitoring two of the solutions. By monitoring the bromide level of the bleach, the replenishment of both the bleach and developer can be controlled, as both are image dependent solutions. By monitoring the silver level of the fix solution, the replenishment of the stop bath, hardner, and fix can be controlled, since all those solutions are bulk dependent solutions.

In order to monitor the bromine and silver concentration in bleach tank 14 and fix tank 15, respectively, portions of the solutions in the tanks are continuously circulated through closed loop systems 31 and 32. Each of the loops 31 and 32 comprises piping 33 and 34, respectively, pumps 35 and 36 respectively, and process controllers 37 and 38, respectively. The process controllers continuously sample and analyze the solutions, as they are circulated by pumps 35 and 36, to determine the chemical activity, such as the bromide and silver levels in the respective solutions.

An example of a process controller which preferably is employed to monitor the bromine and silver concentrations of the type disclosed in Kelch et al. U.S. Pat. No. 3,770,608, which annalyzes a sample of the solution being monitored by comparing the sample with a standard process solution by linear nullpoint potentiometry. For this purpose the controller employs a pair of sensing probes, each of which is equipped with a solid state specific ion sensing membrane. For measurement of silver ion activity the controller employs silver sulfide membranes having a metallic silver backing, and for measurement of bromide ion activity the controller employs silver-backed silver bromide membranes, all as described in U.S. Pat. No. 3,770,608 and a related pending patent application Ser. No. 378,025 filed July 10, 1973.

When process controller 37 determines that the bromine level of the bleach solution within loop 31 is below the standard or reference level, the controller generates a control signal which causes a bleach replenisher to flow from tank 24 to tank 14. Simultaneously therewith a developer replenishing solution is caused to flow from tank 21 to tank 11.

As shown in the figure, when an analysis of a sample of the bleach circulating through loop 31 indicates a low bromine level, and thus a need for replenishment of the image dependent solutions, a signal leaves process controller 37 via line 41 and is transmitted by lines 42 and 43 to control valves 44 and 45 causing the valves to open and feed replenishing solution to the respective developing tanks. The exact flow rates of the replenishment solutions will vary according to the kinds and types of chemicals involved, since all bleaches and/or developers are not consumed at the same rates, and so need not be replenished at the same rates. The same will be true with the stop bath, hardner and fix solutions. Thus, the solutions are all replenished at relative rates. This relationship can be preset into the valves, so that although they receive the same signal, they will operate at different flow rates.

Once the chemical activity has returned to normal or standard level, the signal will cease, and valves 44 and 45 will close. Pumps 46 and 47 are provided to pump the replenishing chemicals from replenishing tanks 21 and 24 to developing tanks 11 and 14 respectively. Pumps 46 and 47 could also be controlled by controller 37, such that, when valves 44 and 45 are opened, pumps 46 and 47 are turned on, and, when valves 44 and 45 are closed, pumps 46 and 47 are turned off. Alternatively, replenishment solution could be continuously fed to the developing tanks, with pumps 46 and 47 running continuously, while the opening of valves 44 and 45 would be adjusted according to the level of chemical activity in bleach tank 14 as measured by controller 37 in loop 31. Thus, there would always be some amount of feed, but provision could be made to shut down the pumps if the rate became zero. The control valves need not be of any particular design and thus could be solenoid activated, pneumatic, or the like.

The fix solution in loop 32 would be monitored in the same manner as is the bleach solution is monitored in loop 31. A signal 50 from process controller 38 would follow lines 51–53 to valves 54–56, to actuate and control the opening and closing of the valves in lines 27, 28, and 30 from the non-image dependent replenishment solution tanks 22, 23, and 25, in the same manner as valves 44 and 45 are controlled. Pumps 57–59 are provided to pump the replenishing chemicals, and may be controlled similarly to pumps 46 and 47.

It may be necessary, in some instances, to provide an interlock between the image dependent controller and the bulk dependent controller which, under certain conditions, will turn the control of the bulk dependent solutions over to the image dependent controller. The reason for this is that, when a large amount of leader is being processed, there is carry out of the bulk dependent chemicals, especially the fix chemicals, by the physical movement of the leader through the bath. Although these chemicals are normally replenished by the bulk control response when the image material begins passing through the processing equipment, when a large amount of leader is processed, more chemicals are removed than the bulk replenisher normally will add. This is because the bulk dependent process controller usually responds to an increase in chemical activity in the bulk dependent sample, e.g., the silver activity in a sample of the fix solution.

As leader passes through the fix tank, silver is carried out, along with the fix chemicals. Instead of the silver activity increasing and the lost fix chemicals being replenished, the silver activity level continues to decrease. The bulk dependent process controller remains unresponsive until film again begins to pass through the process. Meanwhile the level of fix chemicals has become so low that the proper level can just about never be reached. Thus, the concentration of the solution will never catch up. An example of a large amount of leader being processed is a television station news department where the equipment will be allowed to run with only leader material passing through so that the equipment will be ready when an important or recent news story is received which needs immediate processing.

In order to prevent the bulk dependent solution concentrations from getting too low, the bulk and image dependent controllers are interlocked. An arbitrary minimum which represents a relatively large amount of leader material is being processed is assigned for the chemical activity of the bulk dependent sample. Below that point the replenishment of the bulk dependent chemicals is under the control of the image dependent controller, while above that point the control is performed in a normal manner by the bulk dependent controller. When a minimum silver activity level, for example, is reached, the control of the bulk dependent solutions is done by the image dependent controller. While chemicals from the image dependent solutions are also carried out by the leader material, the image dependent controller is usually designed to respond to a decrease in the chemical activity, as contrasted to the bulk dependent controller which responds to an increase. Thus, the carry out of chemicals causes a decrease which the image dependent controller will respond to, and all of the solutions will be replenished at least to the extent of carry out.

In addition to the replenishment of the bleach solution it may be desirable to regenerate the bleach by an oxidation apparatus 60 which may be electrolytic cell or the like located within the bleach recycling loop 31. An example of such a bleach regeneration apparatus is disclosed in Jensen et al. U.S. Pat. application Ser. No. 420,699, filed Nov. 30, 1973, which disclosure is incorporated herein by reference. Since the need for bleach regeneration is related to the need for replenishment of bleach solution, the operation of bleach regenerator 60 may be controlled by process controller 37, so that when the bleach is replenished it is regenerated as well, thus reducing the amount necessary for replenishment.

In a manner similar to the regeneration of the bleach by bleach regenerator 60, a cell 62 may be provided in loop 32 to recover silver from the fix solution, thereby allowing continued recycling of cell 62, which may be an electrolytic cell or the like, is controlled by a signal on line 63 from controller 38 so that it operates only when it is needed, i.e., when the bulk dependent chemicals need replenishment, because of the high level of chemical activity, e.g., a large amount, or above a certain relative amount, of silver.

An example of a process being controlled in accordance with the teachings of the invention is set forth as follows:

EXAMPLE

Film material, comprising leader material and 16 mm and 35 mm color film, was developed by running it through a developing apparatus similar to that diagrammatically illustrated in FIG. 1. The film material (FIG. 2-*a* indicates the kind) was run at a relatively constant 90 feet per minute for almost nine hours, and the replenishment flow rates, based on peak film demand, which in this case was the 35 mm film, were as follows:

| SOLUTION | REPLENISHMENT FLOW RATE |
|---|---|
| Color Developer (CD-2; a p-phenylene diamine derivative developer sold by Kodak) | 0.220 l/min. |
| Ferricyanide Bleach | 0.035 l/min. |
| Stop Bath | 0.020 l/min. |
| Hardner | 0.010 l/min. |
| Fixer | 0.145 l/min. |

FIGS. 2 *a–f* are charts of some of the various solution activities, and additions to those solutions in response to the activities, as a function of time. The chemical activity in the image dependent sample which was monitored was the bromide level in the bleach solution (FIG. 2-*c*), and the controlling levels of activity were concentrations of bromide of between 17.0 and 17.2 grams per liter. The chemical activity of the bulk dependent solution which was monitored was the silver activity in the color fixing bath (FIG. 2-*e*), and the controlling level of silver activity were between about 1.0 and 1.3.

When the bromide level in the bleach decreased below 17.0 g/l., the controller (FIG. 2-*b*) caused the bleach and developer chemicals to be replenished, and the replenishment continued until the bromide level reached approximately 17.2 g/l, at which time the controller caused the replenishment flow to be shut off. The chemical activity in the developer solution (FIG. 2-*d*) could have been the basis for the operation of the image dependent process controller, since its activity was almost exactly the same as the bleach.

The control of the bulk dependent solutions was performed in a manner similar to the image dependent control, but on the basis of the chemical activity of a bulk dependent sample. FIG. 2-*e* shows the variations in the silver activity in the color fixing bath, with the process controller causing solution additions when the silver activity reached approximately 1.3, while ceasing addition when the level reached 1.0. FIG. 2-*f* shows that the control of the silver electrolysis cell, to allow the fix solution to be recycled, is the same as the solution additions, since the electrolysis causes a decrease in the silver activity.

The problem of running a relatively large amount of leader is illustrated in FIG. 2-*e*, where the number 70 designates an arbitrary minimum (0.8) which represents a relatively large amount of leader being processed. When the minimum point was crossed, the bulk dependent additions were controlled by the image dependent controller until at point 72, the minimum concentration was again achieved and the bulk dependent controller resumed normal control.

While the method herein described, and the form of apparatus for carrying this method into effect, constitute preferred embodiments of this invention, it is to be understood that the invention is not limited to this precise method and form of apparatus, and that changes may be made in either without departing from the scope of the invention.

What is claimed is:

1. A method for automatically replenishing chemical compositions in the developer tank, stop bath, hardener solution tank, bleach solution tank, and fix solution tank, which compositions are consumed at variable rates during a photographic process in which said compositions are used to develop photographic film, the compositions of said developer tank and bleach solution tank being image dependent by being consumed on the basis of how much imagery is being processed and the compositions of the stop bath, hardener solution tank, and fix solution tank being non-image and bulk dependent by being consumed on the basis of the amount of film being transported per unit time through the process, comprising:

a. extracting a sample from said bleach solution tank,
b. analyzing said sample from said bleach solution tank to determine the halogen concentration therein, whereby the variation of the imagery, which is directly proportional to the halogen concentration, is determined,
c. adjusting the rate of supply of said image dependent compositions in said developer tank and bleach solution tank in relation to said variation of the imagery and thereby maintain the desired concentration of said image dependent composition and, also during the processing,
d. extracting a sample from said fix solution tank,
e. analyzing said sample from said fix solution tank to determine the silver concentration therein, whereby the amount of film per unit time, which is directly proportional to said silver concentration, is determined, and
f. adjusting the rate of supply of said bulk dependent compositions in said stop bath, hardener solution tank, and fix solution tank in relation to said amount of film per unit tank and thereby maintain the desired concentrations of said bulk dependent compositions.

2. The method of claim 1 wherein said halogen concentration is measured potentiometrically and the rate of supply of said image dependent compositions is adjusted according to the potentiometric value of the said sample.

3. The method of claim 2 wherein the said halogen concentration is measured by linear null-point potentiometry.

4. The method of claim 1 wherein said silver concentration is measured potentiometrically and said bulk dependent compositions are supplied at a rate which is adjusted according to the potentiometric value of said sample.

5. The method of claim 4 wherein the said silver concentration is measured by linear null-point potentiometry.

6. The method of claim 1 comprising the further step of regenerating said bleach solution in response to the halogen concentration in said bleach solution.

7. The method of claim 1 comprising the further step of recycling said fix solution in response to the silver concentration in said fix solution.

* * * * *